US005999891A

United States Patent [19]

Rey-Fabret et al.

[11] Patent Number: 5,999,891

[45] Date of Patent: Dec. 7, 1999

[54] METHOD AND SYSTEM FOR DETECTING THE PRECESSION OF AN ELEMENT OF A DRILL STRING

[75] Inventors: Isabelle Rey-Fabret, Versailles; Claude Mabile, Clamart; Nathalie Oudin, Sanary, all of France

[73] Assignee: Institut Francais du Petrole, Rueil-Malmaison Cedex, France

[21] Appl. No.: 09/103,529

[22] Filed: Jun. 24, 1998

[30] Foreign Application Priority Data

Jun. 25, 1997 [FR] France ..... 97 07931

[51] Int. Cl.[6] ..... E21B 47/00

[52] U.S. Cl. ..... 702/151; 702/6; 702/9; 73/152.43

[58] Field of Search ..... 702/6, 9, 75–76, 702/151; 73/152.03, 152.43, 152.58, 151; 367/34, 49

[56] References Cited

U.S. PATENT DOCUMENTS

| | | | |
|---|---|---|---|
| 4,928,521 | 5/1990 | Jardine | 73/152.43 |
| 5,058,077 | 10/1991 | Twist | 73/152.03 |
| 5,159,577 | 10/1992 | Twist | 73/152.01 |
| 5,313,829 | 5/1994 | Paslay et al. | 73/152.58 |
| 5,402,677 | 4/1995 | Paslay et al. | 73/152.43 |
| 5,419,405 | 5/1995 | Patton | 175/27 |
| 5,439,064 | 8/1995 | Patton | 175/45 |
| 5,550,788 | 8/1996 | Pavone et al. | 702/9 |
| 5,663,929 | 9/1997 | Pavone et al. | 702/9 |

FOREIGN PATENT DOCUMENTS 2 275 283 8/1994 United Kingdom .

OTHER PUBLICATIONS

Vandiver, "Case Studies of the Bending Vibration and Whirling Motion of Dril Collars", *SPE/IADC Drilling Conference*, Paper SPE 18652, Feb. 2–Mar. 3, 1989, New Orleans, pp. 282–290, Dec. 1990.

Zhang et al., "Precession of Rotary Drillstrings Should be Eliminated", *SPE Advanced Tech. Series*, Paper SPE 19360, 3(1):23–28, May 1995.

Henneuse, "Surface Detection of Vibrations and Drilling Omptimization: Field Experience", *IADC/SPE Drilling Conference*, Paper SPE 23888, Feb. 18–21, 1992, New Orleans, pp. 409–423.

I Rey–Fabret et al., "Detecting Whirling Behaviour of the Drill String from Surface Measurements", *SPE Annual Technical Conference and Exhibition*, Paper SPE 38587, Oct. 5–8, 1997, pp. 223–231.

*Primary Examiner*—Marc S. Hoff
*Assistant Examiner*—Bryan Bui
*Attorney, Agent, or Firm*—Millen, White, Zelano & Branigan, P.C.

[57] ABSTRACT

The present invention relates to a system and to a method for automatic detection of the precession of an element of a drill string, in particular of the bottomhole assembly of a drill string. The method comprises a stage of surface acquisition of signals linked with the vibration of the end of the drillpipes, automatic processing on at least one signal in order to detect a jump in average and a significant line in the spectrum of the signal. A precession criterion is calculated and an alarm is set off. The invention further relates to a system for detecting the precession of an element of a drill string.

12 Claims, 5 Drawing Sheets

METHOD AND SYSTEM FOR DETECTING THE PRECESSION OF AN ELEMENT OF A DRILL STRING

FIELD OF THE INVENTION

The present invention relates to the field of oilwell and gas well drilling techniques, and more particularly to techniques allowing to detect the precession, during drilling, of the element of the drill string commonly referred to as "BHA" for "Bottom Hole Assembly". To simplify, the part of the drill string concerned by the present invention will be referred to as BHA in the description hereafter.

BACKGROUND OF THE INVENTION

The BHA is subjected to precession when it undergoes a proper rotating motion notably due to flexion. This proper motion is influenced by drilling parameters (weight on bit, rotating speed, etc.) and geometric parameters (dimensions of the BHA constituents, bit diameter, wellbore trajectory, formation type, etc.). It is considered to be a serious dysfunctioning since it prevents correct progress of the drilling operation and can even cause considerable material damage, notably to the BHA elements.

The dysfunctioning known as "whirling" is known in the trade, but for the time being it has been taken into account only for the drill bit in order to reduce breakage and excessive wear of the cutting elements due to this dysfunctioning.

SUMMARY OF THE INVENTION

The present invention thus relates to a method for detecting the precession of an element of a drill string rotating in a well. The method comprises the following stages:

- acquisition of at least one measurement by measuring means placed close to the surface, said measurement being representative of the vibration of said element in said well,
- automatic processing of said measurement comprising locating a jump in average and locating a significant line in the spectrum of said measurement, said locations appearing in a time interval shorter than about 10 seconds,
- determination of a precession criterion from the characteristics of said line,
- setting off of an alarm if the criterion reaches a determined threshold value.

The measurements acquired at the surface can depend on the torque S(t) and on the tension V(t) at the top of the drillpipes.

The jump in average can be detected from the measurement of torque S(t) and said significant line from the measurement of tension V(t).

The significant line can be in the frequency interval corresponding to interval $I=[\omega/2\pi,|\Omega b/2\pi|]$, $\omega$ being the average speed of the string and $$\Omega_b = -\omega\frac{R_c}{(R_b - R_c)},$$

where $R_c$ is the radius of said element in precession and $R_b$ the radius of the well, and said line can have a power at least greater than 65% of the main maximum.

$C=\Omega/\Omega b$ can be calculated, $\Omega$ being calculated from the frequency of said significant line, and the alarm can be set off when C is greater than about 0.5, preferably 0.6.

The invention also relates to a system for detecting the precession of an element of a drill string in rotation in a well. The system comprises:

- means intended for acquisition of at least one measurement, said measuring means being placed close to the upper part of said string, said measurement being representative of the vibration of said element in said well,
- means allowing automatic processing of said measurement, comprising means for locating a jump in average and for locating a significant line in the spectrum of said measurement, said locations appearing in a time interval shorter than about 10 seconds,
- means for determining a precession criterion from the characteristics of said line,
- means for setting off an alarm if the criterion reaches a determined threshold value.

The acquisition means can comprise measurement detectors for measurements linked with the torque S(t) and the tension V(t) at the upper end of the drill string.

Torque S(t) can be measured by the rotating motive means of the string and the tension can be measured from the tension of the cable.

It may be reminded that precession can be defined as the motion of the drill collar when contact of the drill collar against the walls of the well generates an orbital motion of one or more sections of the BHA. It is thus a composition of two rotating motions.

If we take:

- the rotating speed imposed on the drill string by the surface equipment (rotation about the axis of the string),
- the proper rotating speed due to precession (rotation about the axis of the wellbore),
- V the sliding velocity at the contact point (in case there is no shock).
- b the precession speed without sliding (V=0).
- $R_b$ the radius of the well and $R_c$ the radius of a section in precession, we obtain the following relation: $V=(R_b-R_c)\cdot\Omega+R_c\cdot\omega$, therefore for V=0, we have $\Omega b=-\omega\cdot R_c/(R_b-R_c)$.

$s=\Omega/\Omega b$ is defined.

When $\Omega$ goes in the same direction as $\omega$, the precession is referred to as a forward precession, otherwise it is referred to as backward precession. Synchronous precession ($\Omega=\omega$) is the most unfavourable one as regards abrasion of the drill string because it always occurs in the same place and the sliding velocity has a maximum value. On the other hand, in backward precession, there is no specific abrasion phenomenon but, the frequency being high, the fatigue is also high. In fact, it is an alternate flexion situation which is all the higher as we come closer to $\Omega b$. In practice, the major part of the breakages and failures is linked with fatigue, and a high backward precession, i.e. when $s=\Omega/\Omega b$ approaches 1, therefore has to be avoided as a priority.

The aim of the detection is to determine $\Omega$, to deduce therefrom the precession conditions by studying the value of s, and to set off an alarm if necessary. Several alarm levels can be defined according to the value of s.

The influence factors of precession are mainly the operational drilling parameters (rotating speed, weight on bit, mud type . . . ), the well pattern (well dimensions, well inclination . . . ) and the type of rock drilled.

In fact, it appears that the precession tendency increases when the weight on bit decreases and the rotating speed increases. Heavy friction between the wall and the BHA (because of a rough wall and/or of a low-lubricating mud) promotes backward precession. The same facts can be observed in the case of a hard rock, on the one hand damping of the bit/rock interaction and of the vibrations is lower therein, and on the other hand the drilling rate is generally not very high.

Furthermore, the bending strain is naturally limited by the bore diameter.

In deflected wells, it is reduced by damping of the vibrations at the level of the stabilizers.

Precession is therefore particularly present in vertical or low-deflection wells or well sections.

In practice, the major part of the breakages and failures are linked with the fatigue, therefore backward precession of the BHA mainly has to be avoided. The remedy nearly always consists in stopping the rotation of the pipe in order to eliminate the precession. Detecting the precession is therefore essential to stop the motion before it becomes too extensive.

It is also very advantageous to determine the precession phenomenon from characteristic signals which can be obtained by placing detectors on the upper end of the drillpipes connected to the upper part of the BHA. In fact, the bottomhole detectors (placed at the level of the BHA) require heavy transmission means insofar as a substantial volume of information is required here.

BRIEF DESCRIPTION OF THE DRAWINGS

Other features and advantages of the present invention will be clear from reading the description hereafter of a non limitative embodiment example, with reference to the accompanying drawings wherein.

DETAILED DESCRIPTION OF THE INVENTION

According to the invention, the simplified flowchart of the BHA precession alarm is as follows:

A set of detectors supplies characteristic measurements of the lateral vibrations of the BHA (the torque and the tension for example) to:

means intended for acquisition of said measurements, which forward the corresponding signals to:

automatic data processing means which determine or not the setting off:

of an alarm.

The main objective of the invention is to detect precession only from the signals available at the surface. However, flexion phenomena are hardly perceptible at the surface because, on the one hand, the dissipation of the flexional waves (structural and due to the well fluid) is so high that they tend to disappear before they reach the surface and, on the other hand, the well is not a good conducting guide for flexional waves.

However, there are many combinations between the different modes (longitudinal, torsional, flexional). It is therefore possible to find characteristic precession signs in surface signals other than flexion.

Figure 1:
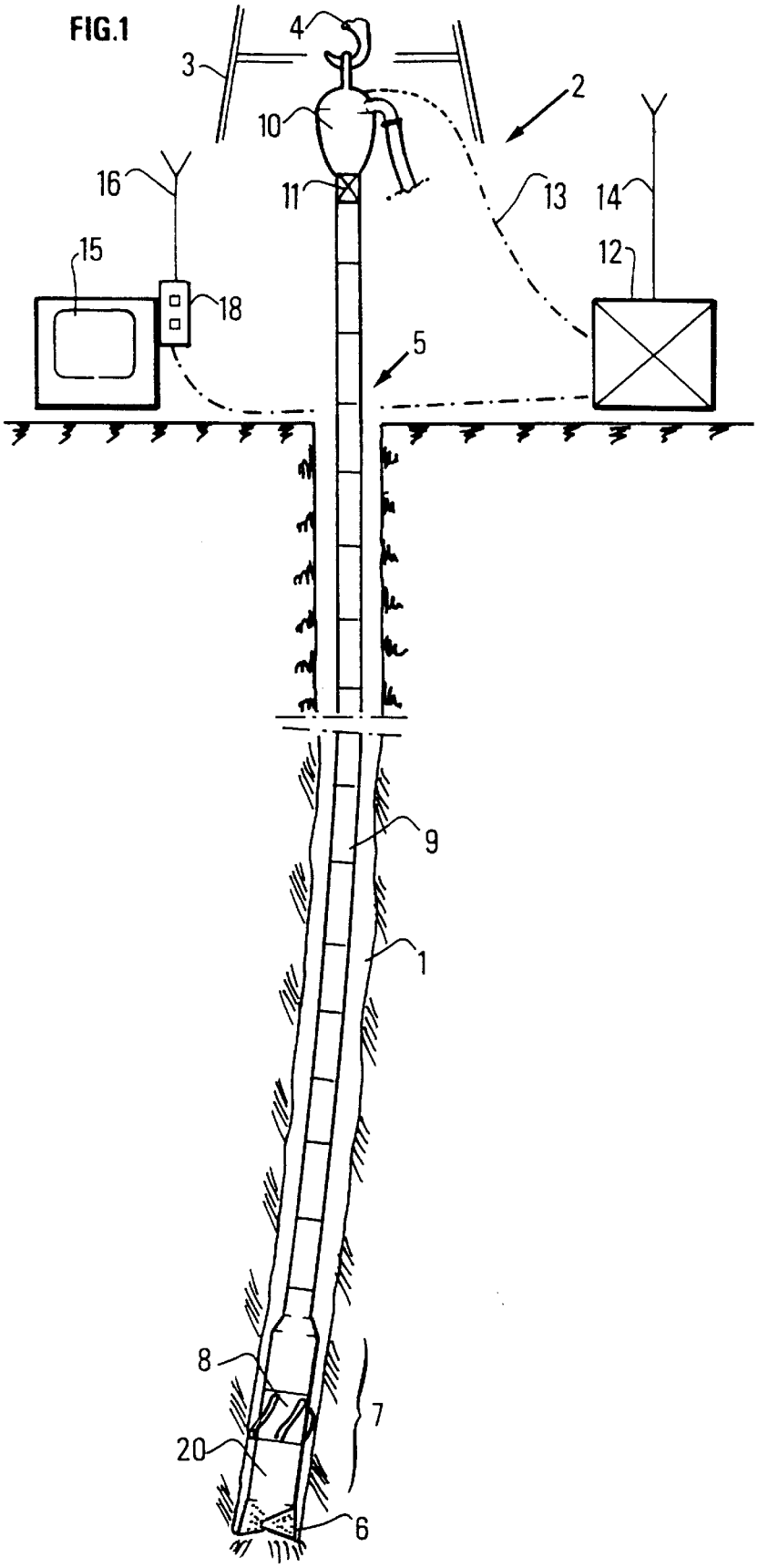
FIG. 1 diagrammatically shows a drilling assembly comprising a precession detection system according to the invention.

FIG. 1 describes the drilling of a well 1 by means of a surface installation 2 comprising a rig 3 and suspension means 4 from which drill string 5 is suspended. As it is well-known in the drilling art, drill string 5 is made up of a drill bit 6, a bottomhole assembly 7 in which one or more stabilizers 8 can be included, drillpipes 9 which are made up to provide a mechanical connection with swivel 10, a power swivel for example, suspended from suspension means 4. The present invention relates to the precession of a part of BHA 7.

A sub 11 comprises detectors sensitive to the vibration of the drill string. The vibrations recorded can be due to torsion, flexion, tension or even to the pressure in the drilling fluid injected through swivel 10. In the present example, the detectors are sensitive to the torque and to the tension at the upper end of pipes 9. The torque can be measured by placing suitable detectors in the means intended for rotation of the string: rotary table or power swivel 10. The tension can also be measured from the tension of a section of the drilling cable.

Means 12 allowing acquisition and processing of the signals corresponding to the surface torque and tension vibration, S(t) and V(t) respectively, are connected to instrument-carrying sub 11 either by a cable 13 or by a radio wave received by antenna 14. A drilling control cab 15 receives, either by radio means 16 or by cable 17, information from acquisition and processing means 12. This information can set off alarm type signalling means 18, for example lights of different colours according to a specific precession level.

The signals characteristic of the lateral vibrations which are used by the automatic data and alarm processing means in the present example are:

S(t)=surface torque,

V(t)=surface tension.

Automatic data processing is performed according to the following pattern:

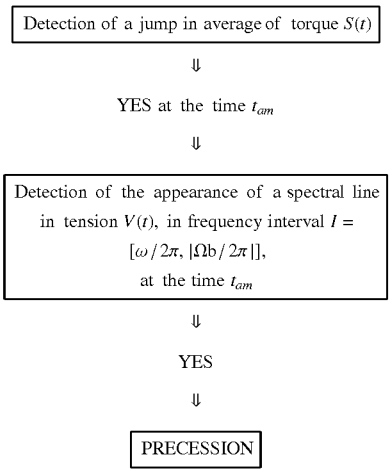

It may be reminded that:

ω is the instantaneous rotating speed transmitted to the drilling assembly by the engine.

Ωb is the precession speed without sliding. It is calculated from the expression as follows:

$$\Omega_b = -\omega \frac{R_c}{(R_b - R_c)}$$

where $R_c$ is the radius of the BHA and $R_b$ the radius of the well.

$t_{am}$ is the time when a jump in average is detected in the temporal processed signal, here the surface torque S(t).

The following documents are mentioned here by way of reference:

Detection of Abrupt Changes. Theory and Application, by Basseville and Nikiforov-Prentice Hall Information and System Sciences Series, 1993;

Digital Processing of Random Signals, Theory and Methods, by Porat-Prentice Hall Information and System Sciences Series, 1994.

Temporal Average Jump Detection

An example of automatic processing of the detection of the temporal processed signal average jump is given hereafter (the torque for example here).

To detect the jump in average of the torque, one can decide to use sliding windows, a large-size one (2000 points for example) and a small-size one (400 points for example) which contains the most recent points of the larger window. The average obtained in the large window is then compared with that obtained with the small window. When the average changes, the two results become substantially different because the small window is very sensitive to the change whereas the large window is much less sensitive thereto. This comparison can be made from the logarithm of the likelihood ratio of the two averages, calculated by continuous computation by means of the algorithm CUSUM. Algorithm CUSUM was described by M. Page in 1954 in "Continuous Inspection Schemes". Biometrika, Vol.41, pp. 100–115.

Algorithm CUSUM allows to give precisely the time $t_{am}$ when a change in the average of the signal occurs.

Spectral Change Detection

From the moment when the time $t_{am}$ of temporal average change of the torque is known, the spectrum of the tension signal before this time and the spectrum after this time can be calculated and compared. These spectra are useful in the frequency band $I=[\omega/2\pi,|\Omega b/2\pi|]$ mentioned in the flowchart above. It is in this interval that one tries to detect the appearance of a line.

To compare them, two solutions are proposed:

1) A comparison can again be made, this time as regards frequency, between a small window and a large window as defined above. To that effect, the frequency characteristics of the signals have to be known precisely enough. The signal is thus previously modelled by means of an autoregressive modelling. The spectral distance between the two spectra of the two windows can be calculated thereafter, using algorithm CUSUM again;

2) direct comparison of the spectra before and after $t_{am}$. This method consists in establishing the direct difference between the two spectra thus calculated while assuming that there is a slight fluctuation in the value of the frequency associated with each line.

Whatever the solution selected, the comparison between the two spectra allows the following question to be answered:

"At the time $t_{am}$, did a line appear in interval I?"

If the answer is no, the alarm is not set off and detection of a possible temporal average change in the torque signal is continued.

If the answer is yes, the power of this line is then determined in relation to the others in order to determine whether it is significant. A specific percentage of the total power of the signal is defined as a plateau for selecting "significant" lines.

Thus, at the end of the automatic data processing, lines which are considered to be important and which can be a proof of the presence of a precession motion in the BHA have been selected. The frequency of the significant line allows to calculate the precession speed Ω.

The alarm can be described as follows:

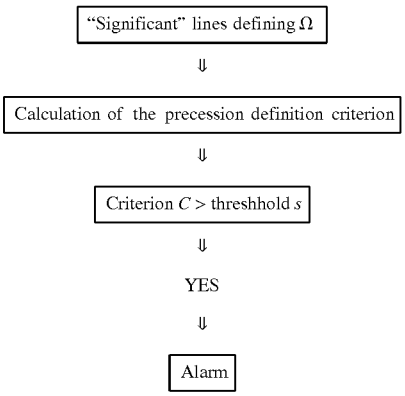

A precession characterization criterion C is defined as follows:

$C=\Omega/\Omega b$, where Ω is the proper rotating speed of the BHA in the precession motion thereof.

A threshold s is also defined such that, if C>s, the precession considered is a backward precession, which is therefore very harmful to the drill string.

An alarm is thus set off insofar as the calculation of criterion C and its comparison with threshold s allows to conclude that a backward precession motion of the BHA has appeared.

Figure 2:
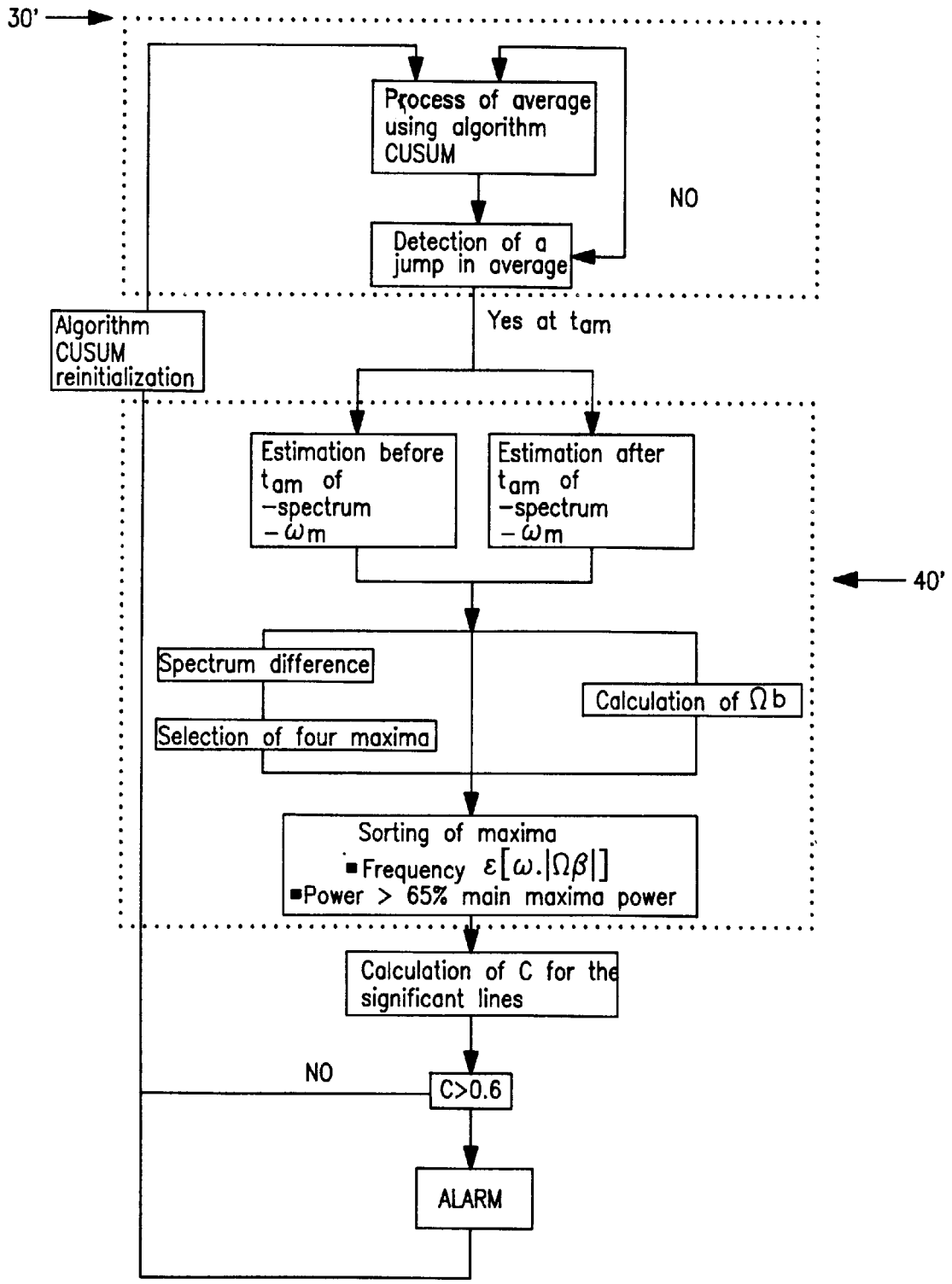
FIG. 2 is an example of a flowchart of the method.
Figure 3:
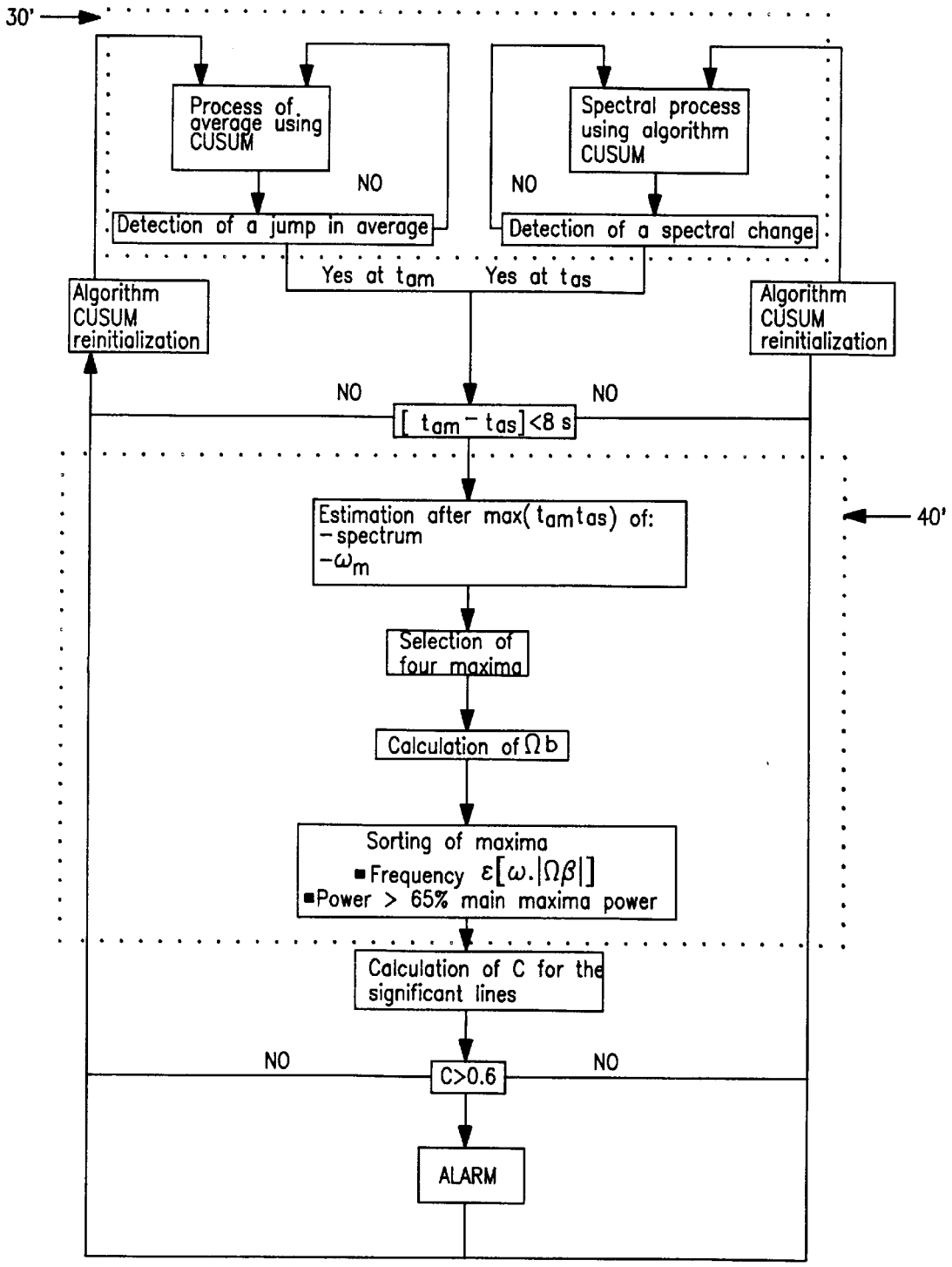
FIG. 3 is another flowchart example.

FIGS. 2 and 3 illustrate two more detailed automatic data processing and alarm setting off algorithms based on the precession detection principles described above.

According to the flowchart of FIG. 2, a spectral processing is performed only when the time $t_{am}$ when a jump in average has been detected (block 30) has been determined. Block 40 represents frequency processings on upstream and downstream windows in relation to $t_{am}$.

In this block 40, an estimation of the torque spectrum before and after the jump in average is calculated by means of conventional signal processing methods (for example: averaged periodograms, high-resolution methods . . . ). The average of the rotating speed considered to be stationary when whirling appears is also calculated. The difference between the spectra thus obtained is then evaluated and the four most energetic lines are for example kept.

Parallel (case of FIG. 2) or sequential (case of FIG. 3) calculation of Ωb is carried out from ω and from the physical characteristics $R_b$ and $R_c$.

Finally, one or more lines are selected by sorting out the various spectral lines according to their energy, for example at 65% in relation to the maximum energy, and according to their frequency by keeping only the frequencies belonging to interval $I=[\omega/2\pi,|\Omega b/2\pi|]$.

After block 40, C is calculated for the significant line.

In this example, the alarm threshold is 0.6. If C is greater than 0.6. an alarm is set off to prevent the considerable risk of an imminent backward type dysfunctioning.

FIG. 3 shows another example of automatic processing where monitoring of the average and of the spectral content is performed concurrently (block 30'). If there is a jump in average at the time $t_{am}$ and a spectral change at the time $t_{as}$, and if these two times are sufficiently close to each other, for example if $|t_{am}-t_{as}|$ is less than 8 seconds, the search for a significant line is then started (block 40'). The functionalities are thereafter the same for setting off an alarm.

These various procedures are only automatic alarm setting off examples concerning the precession of the BHA but other procedures are possible, for example an automatic processing based on Bayesian statistics.

Figure 4A:
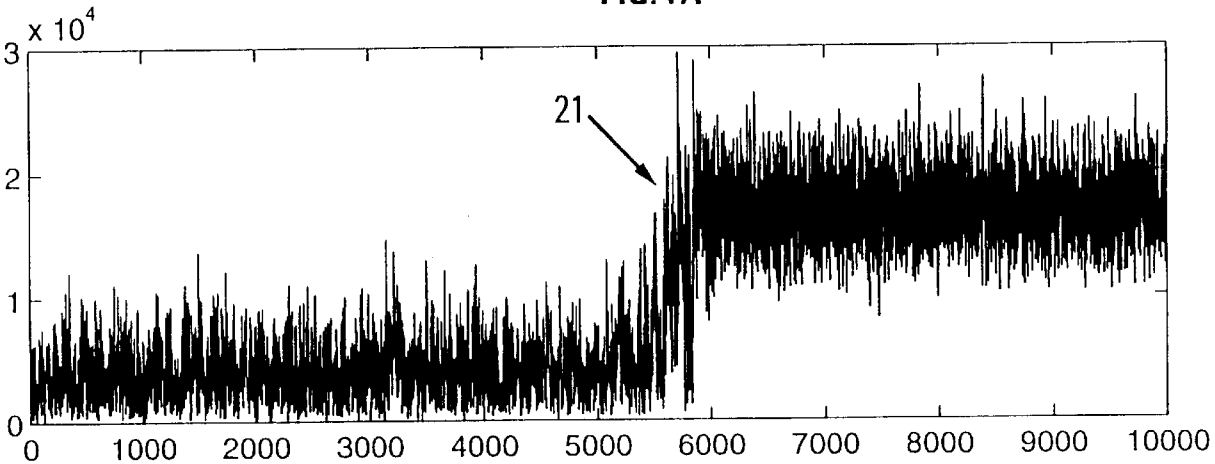
FIGS. 4*a* and 4*b* show the measurement and the spectrum of the BHA flexion.

FIGS. 4*a*, 4*b*, 5*a* and 5*b* are comparative examples of what can be actually measured in the BHA and of what is measured at the surface. FIG. 4*a* is a recording of the flexion observed at the level of the drill collars, for example in sub 20 (FIG. 1). Such measuring means are for example described in document EP-B1-0,558,379 mentioned here by way of reference. The jump in average bears reference number 21.

Figure 4B:
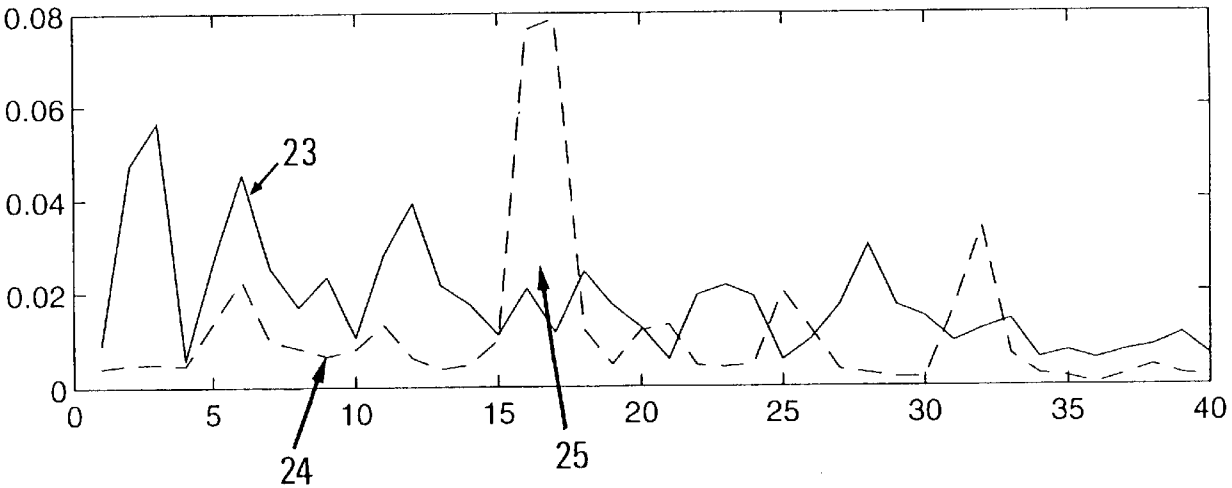
Figure 5A:
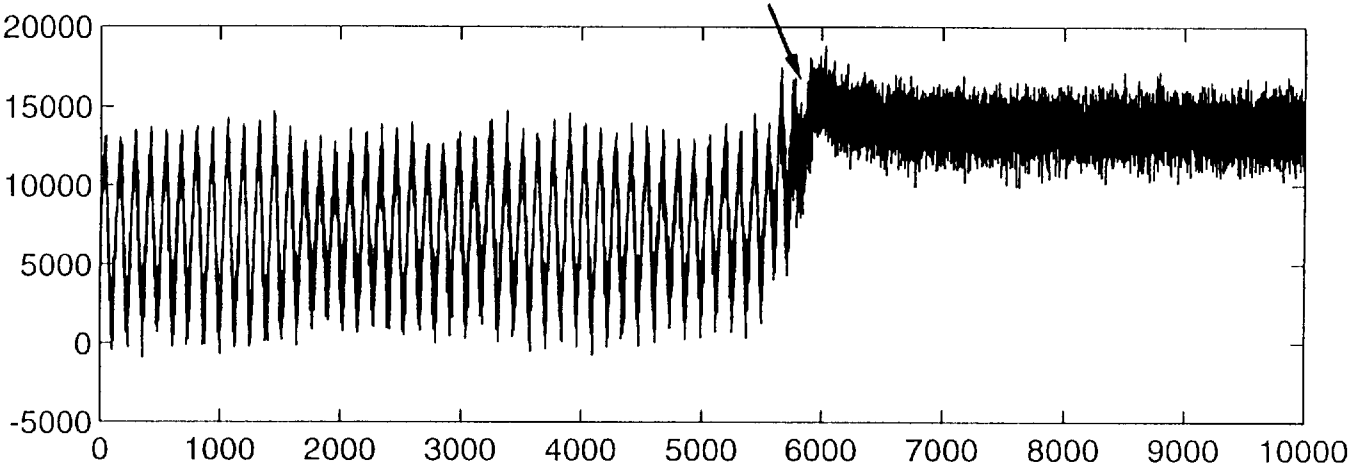
FIGS. 5*a* and 5*b* show the surface torque measurement and the surface tension spectrum.
Figure 5B:
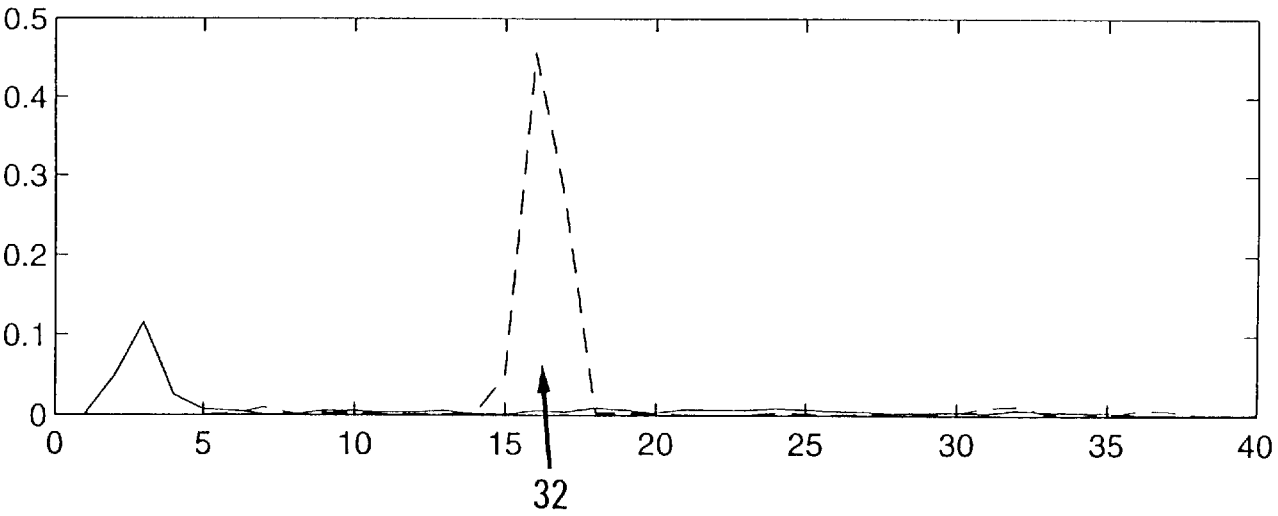

FIG. 4*b* gives the spectrum corresponding to the signal of the bending moment at the level of the BHA. Solid curve 23 corresponds to the spectrum upstream from the jump in average, i.e. without whirling, and dotted curve 24 corresponds to the spectrum after the jump in average, i.e. with whirling. The line bearing reference number 25 is considered to be significant because it is in the 15–20 Hertz frequency interval and has a characteristic power.

The vibration signals of the torque (FIG. 5*a*) and the surface tension spectrum (FIG. 5*b*) have been simultaneously recorded at the surface. The jump in average 31 actually corresponding to the BHA whirling and the significant line with the same frequency as the frequency of the whirling directly recorded downhole can also be seen here.

We claim:

1. A method for detecting precession of an element of a drill string in rotation in a well, comprising the following stages:

acquisition of at least one measurement by measuring means placed close to the surface, said measurement being representative of the vibration of said element in said well, automatic processing of said measurement, comprising locating a jump in average and locating a significant line in the spectrum of said measurement, said locations appearing in a time interval shorter than about 10 seconds, determination of a precession criterion from the characteristics of said line, setting off of an alarm if the criterion exceeds a determined threshold value.

2. A method as claimed in claim 1, wherein said measurements acquired at the surface depend on the torque S(t) and on the tension V(t) at the top of the drillpipes.

3. A method as claimed in claim 2, wherein the jump in average is detected from the measurement of torque S(t) and wherein said significant line is determined from the measurement of tension V(t).

4. A method as claimed in claim 1, wherein said significant line is in a frequency interval corresponding to interval $I=[\omega/2\pi,|\Omega b/2\pi|]$, $\omega$ being the average speed of the string and $$\Omega_b = -\omega\frac{R_c}{(R_b - R_c)},$$

where $R_c$ is the radius of said element in precession and $R_b$ is the radius of the well, and said line has a power at least greater than 65% of the main maximum.

5. A method as claimed in claim 4, wherein $C=\Omega/\Omega_b$ is calculated, $\Omega$ being calculated from the frequency of said significant line, and wherein said alarm is set off when C is greater than about 0.5, preferably greater than 0.6.

6. A method as claimed in claim 4, wherein said measurements acquired at the surface depend on the torque S(t) and on the tension V(t) at the top of the drillpipes.

7. A method as claimed in claim 6, wherein the jump in average is detected from the measurement of torque S(t) and wherein said significant line is determined from the measurement of tension V(t).

8. A method as claimed in claim 7, wherein $C=\Omega/\Omega_b$ is calculated, $\Omega$ being calculated from the frequency of said significant line, and wherein said alarm is set off when C is greater than about 0.5, preferably greater than 0.6.

9. A method as claimed in claim 4, wherein the jump in average is detected from the measurement of torque S(t) and wherein said significant line is determined from the measurement of tension V(t).

10. A system for detecting precession of an element of a drill string in rotation in a well, comprising:

means for acquisition of at least one measurement, said measuring means being placed close to the upper part of said string, said measurement being representative of the vibration of said element in said well, means for automatic processing of said measurement, comprising means for locating a jump in average and for locating a significant line in the spectrum of said measurement, said locations appearing in a time interval shorter than about 10 seconds, means for determining a precession criterion from the characteristics of said line, means for setting off an alarm if the criterion exceeds a determined threshold value.

11. A system as claimed in claim 10, wherein the acquisition means comprise measurement detectors for measurements linked with the torque S(t) and the tension V(t) at the upper end of the string.

12. A system as claimed in claim 11, wherein torque S(t) is measured by the rotating motive means of the string and wherein the tension is measured from the tension of the cable.

* * * * *